US006199819B1

(12) United States Patent
Churillo

(10) Patent No.: US 6,199,819 B1
(45) Date of Patent: Mar. 13, 2001

(54) UMBRELLA HOLDER

(76) Inventor: Charlie T. Churillo, 410 Bally Way, Niceville, FL (US) 32578

( * ) Notice: Subject to any disclaimer, the term of this patent is extended or adjusted under 35 U.S.C. 154(b) by 0 days.

(21) Appl. No.: 09/280,163

(22) Filed: Mar. 29, 1999

(51) Int. Cl.[7] ..... A47G 25/12
(52) U.S. Cl. ..... 248/540; 135/16
(58) Field of Search ..... 248/550, 538, 248/534, 541, 96; 135/16, 19

(56) References Cited

U.S. PATENT DOCUMENTS

| | | | | |
|---|---|---|---|---|
| D. 252,318 | | 7/1979 | Kriegner | D8/373 |
| D. 253,165 | | 10/1979 | Scott | D8/396 |
| D. 383,967 | | 9/1997 | DeMars | D8/354 |
| D. 389,334 | | 1/1998 | Attridge | D6/418 |
| 593,360 | | 11/1897 | Lottermoser et al. . | |
| 970,751 | | 9/1910 | Pranke . | |
| 2,822,143 | | 2/1958 | Johansen | 248/41 |
| 3,148,851 | | 9/1964 | Condon | 248/41 |
| 3,237,899 | | 3/1966 | Lewis | 248/40 |
| 3,304,035 | | 2/1967 | Davis | 248/40 |
| 3,304,036 | | 2/1967 | Davis | 248/41 |
| 3,866,934 | | 2/1975 | Braun | 280/36 |
| 4,522,300 | * | 6/1985 | Hamblet | 135/16 X |
| 4,570,894 | | 2/1986 | Miele | 248/534 |
| 4,711,422 | * | 12/1987 | Ibanez | 248/515 |
| 4,974,807 | | 12/1990 | Moineau | 248/539 |
| 5,265,839 | * | 11/1993 | Buckley | 248/538 |
| 5,277,211 | * | 1/1994 | Hendershot | 135/16 |
| 5,310,155 | | 5/1994 | Wu | 248/514 |
| 5,411,237 | | 5/1995 | Dougherty | 248/534 |
| 5,431,364 | | 7/1995 | Etler | 248/514 |
| 5,478,041 | | 12/1995 | Mayne | 248/514 |
| 5,657,957 | | 8/1997 | Graham | 248/534 |
| 5,711,331 | * | 1/1998 | Harris | 135/16 |
| 5,873,550 | * | 2/1999 | Phillips | 248/74.1 X |
| 6,032,917 | * | 3/2000 | Shannon | 248/514 |
| 6,082,694 | * | 7/2000 | Joyce | 135/16 X |

* cited by examiner

*Primary Examiner*—Ramon O. Ramirez
(74) *Attorney, Agent, or Firm*—Peter Loffler

(57) ABSTRACT

An umbrella holder holds an umbrella and attaches to a golf bag and has a first clamp which is made from a resilient material and resiliently clips onto the golf bag and a second clamp, the second clamp having a pair of jaws connected by a spring-loaded hinge. A non-scuff material can be secured to the first clamp to protect the surfaces of the golf bag as well as to the second clamp to protect the surface of the umbrella.

12 Claims, 6 Drawing Sheets

UMBRELLA HOLDER

BACKGROUND OF THE INVENTION

1. Field of the Invention

The present invention relates to an umbrella holder for attachment to a golf bag.

2. Background of the Prior Art

The use of umbrellas during the game of golf has been widely practiced during both rain periods as well as sun periods. The umbrella protects the golfer from the heat of the sun and also protects the golfer as well as his golf bag and its contents from the rain. Manually holding an umbrella can prove quite cumbersome. As the golfer takes each shot, the umbrella must be temporarily discarded thereby relinquishing its benefits. Furthermore, holding an umbrella for an entire 18 holes of golf will prove quite tiring.

To solve these problems, umbrella holders have been developed in the art. Such devices relieve the golfer from manually holding the umbrella by attaching the umbrella to either a golf cart or to the golf bag. However, the prior art devices are either too complex to build or use, require a permanent alteration to the golf bag, or are adapted to attach only to a golf cart thereby being unusable by golfers who do not employ golf carts.

Therefore, there is a need in the art for an umbrella holder that quickly and easily attaches directly to a golf bag without the need to modify the golf bag. Such a device should of relatively simple and straightforward design and construction and should be easy to use.

SUMMARY OF THE INVENTION

The umbrella holder of the present invention addresses the aforementioned needs in the art. The umbrella holder quickly and easily attaches to and detaches from a golf bag without the need to modify the golf bag. The umbrella holder is of relatively simple design and construction.

The umbrella holder is comprised of a first clamp having a first surface and a second surface. The first clamp is a resilient clip member made from a resilient material such as spring metal, plastic, appropriate resins, and the like. The first clamp has a first leg with a first end, a medial portion, and a second end. A second leg extends diagonally from the second end of the first leg, a curved portion extends from the second leg, and a third leg having a third end and a fourth end, extends from the curved portion. The third leg is disposed generally parallel to the first leg and terminates proximate the medial portion of the first leg. A second clamp is secured to the first clamp. The second clamp is comprised of a first jaw having a flange and a second jaw joined to the first jaw by a spring-loaded hinge. An appropriate non-scuff material such as rubber or neoprene can be secured to inner surfaces of the first clamp, the first jaw, the second jaw, as well as to the first end of the first leg and the fourth end of the third leg.

The first clamp is secured to a golf bag such that the first leg and the second leg are inserted into the golf bag with the third leg remaining external therefrom. The curved portion rests on the rim of the golf bag. The second clamp is opened by separating the two jaws, with the shaft of the umbrella being inserted between the open jaws. The jaws are thereafter closed by the bias of the spring-loaded hinge.

BRIEF DESCRIPTION OF THE DRAWINGS

Similar reference numerals refer to similar parts throughout the several views of the drawings.

DESCRIPTION OF THE PREFERRED EMBODIMENT

Figure 1:
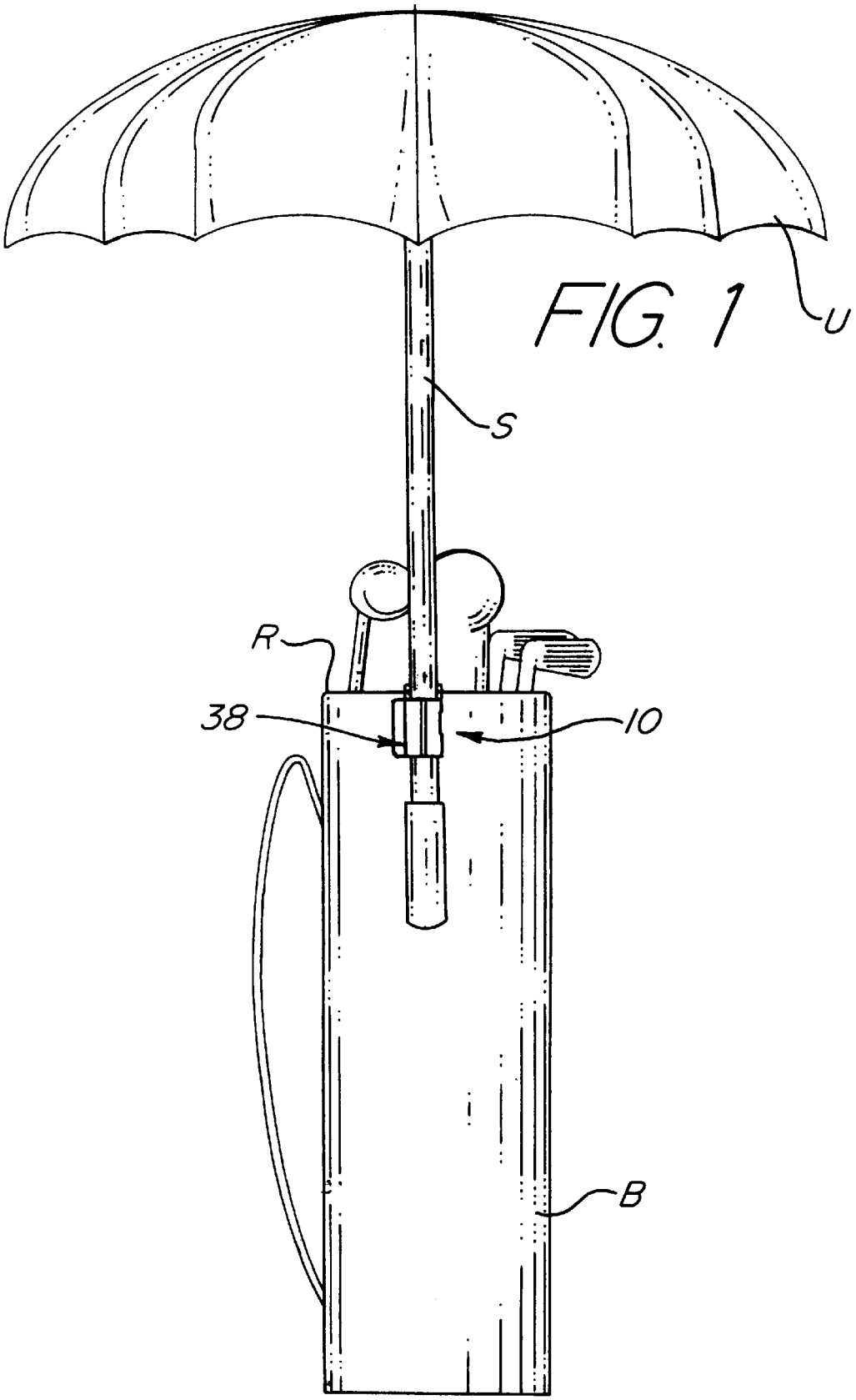
FIG. 1 is an environmental view of the umbrella holder of the present invention secured to a golf bag.
Figure 2:
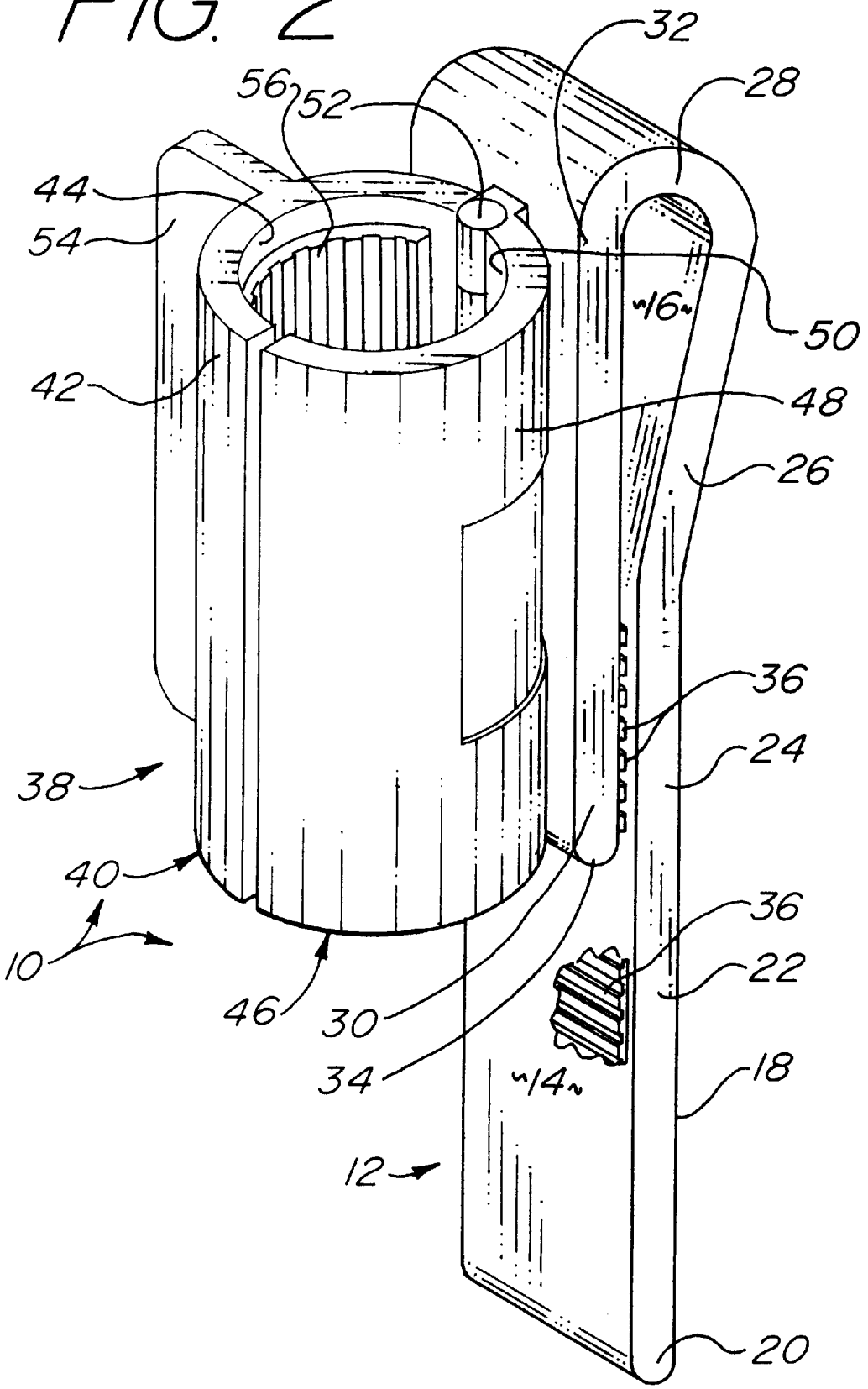
FIG. 2 is a front perspective view of the umbrella holder.
Figure 3:
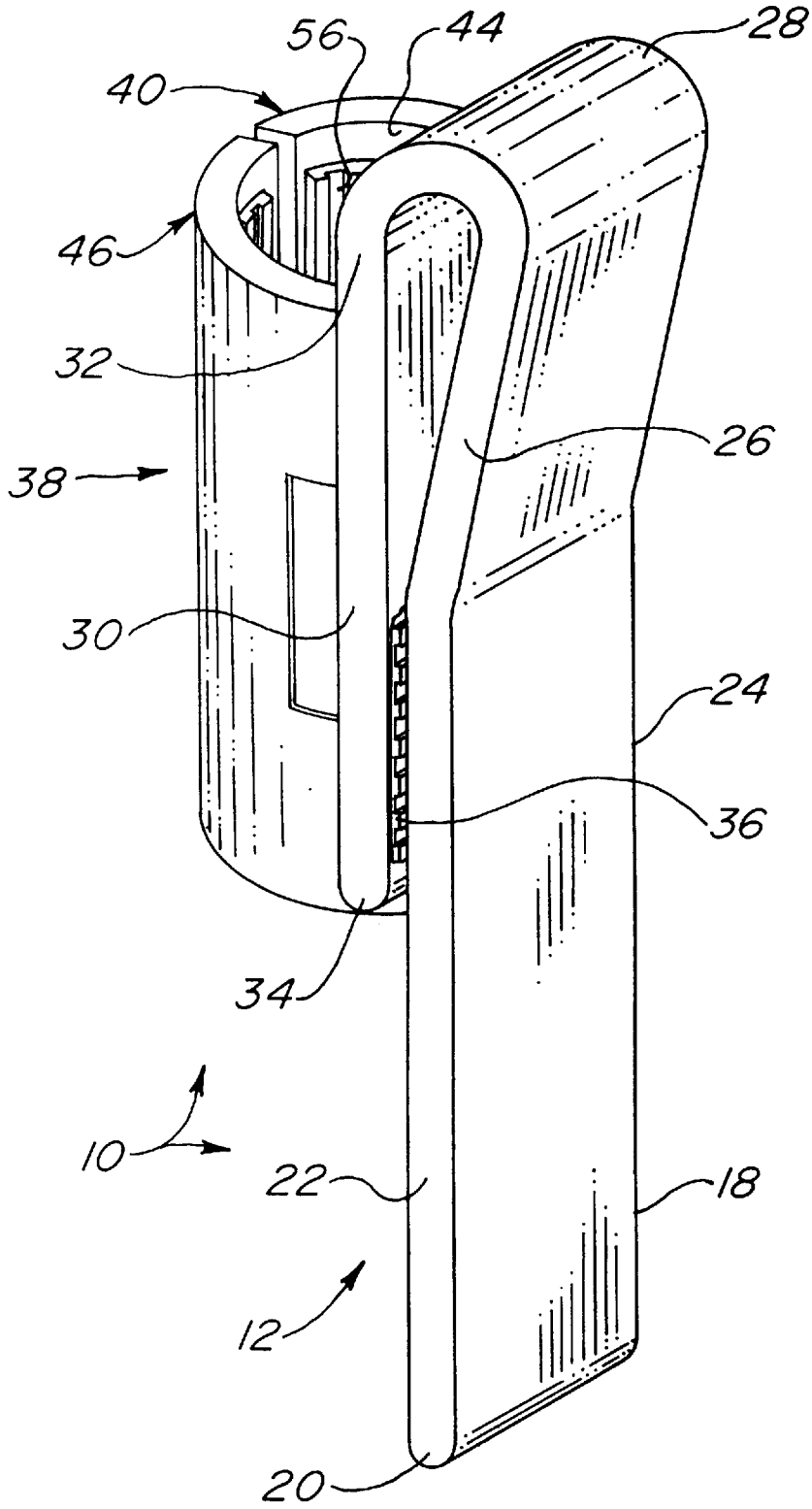
FIG. 3 is a rear perspective view of the umbrella holder.
Figure 4:
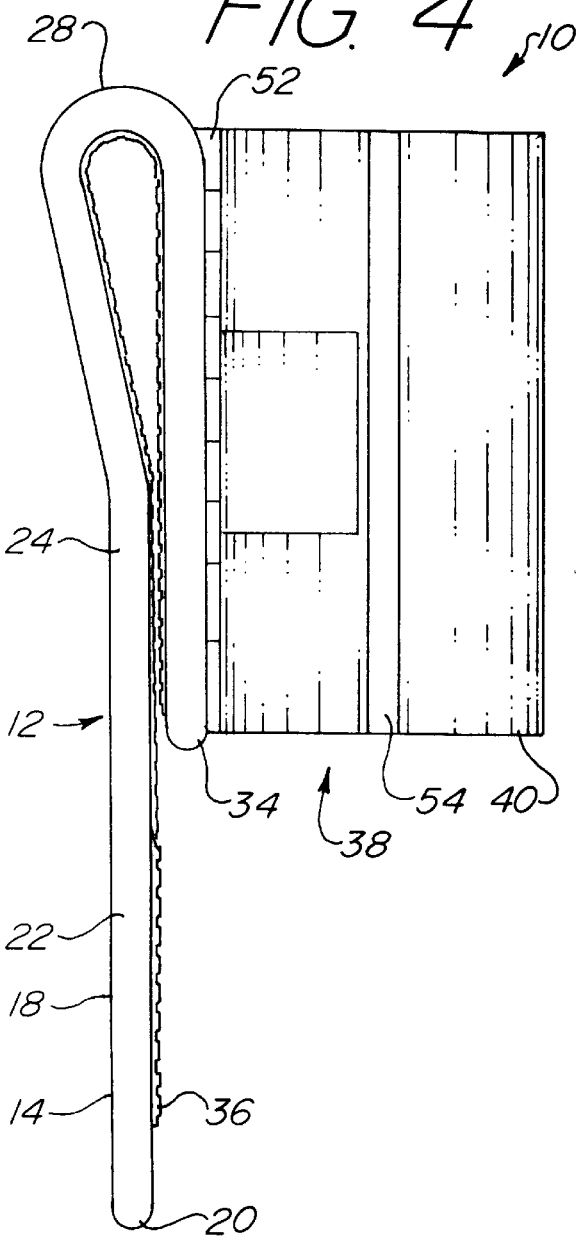
FIG. 4 is a side elevation view of the umbrella holder.
Figure 6:
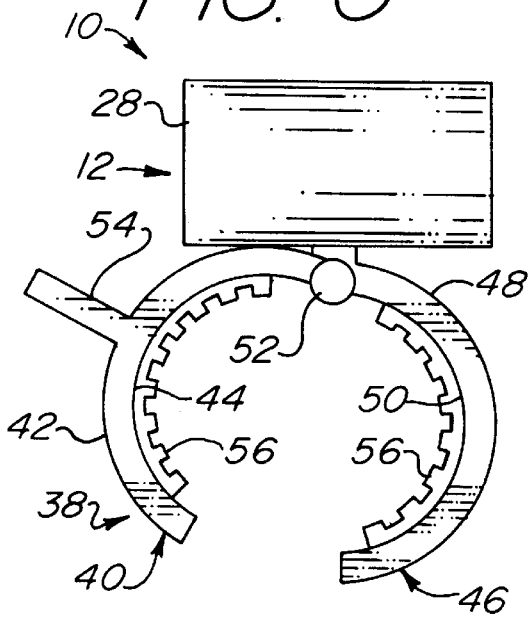
FIG. 6 is a top plan view of the umbrella holder with the second clamp in an open position.
Figure 5:
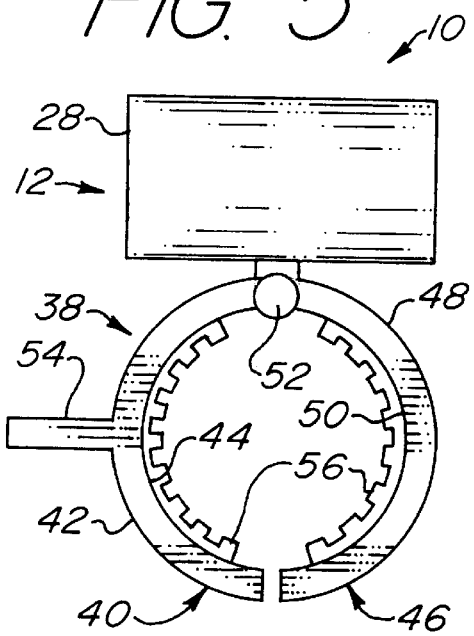
FIG. 5 is a top plan view of the umbrella holder with the second clamp in a closed position.
Figure 7:
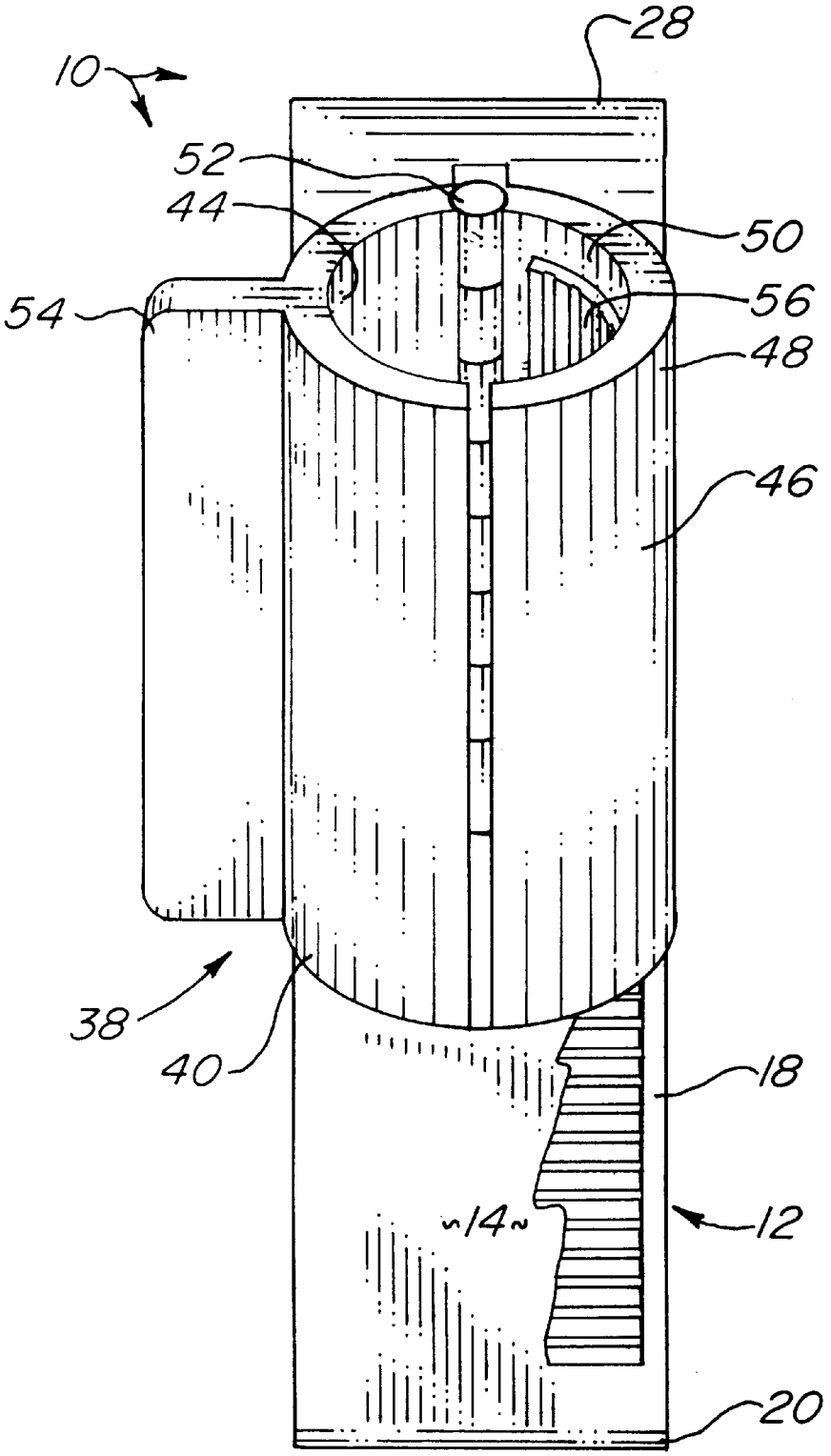
FIG. 7 is a front elevation view of the umbrella holder.
Figure 8:
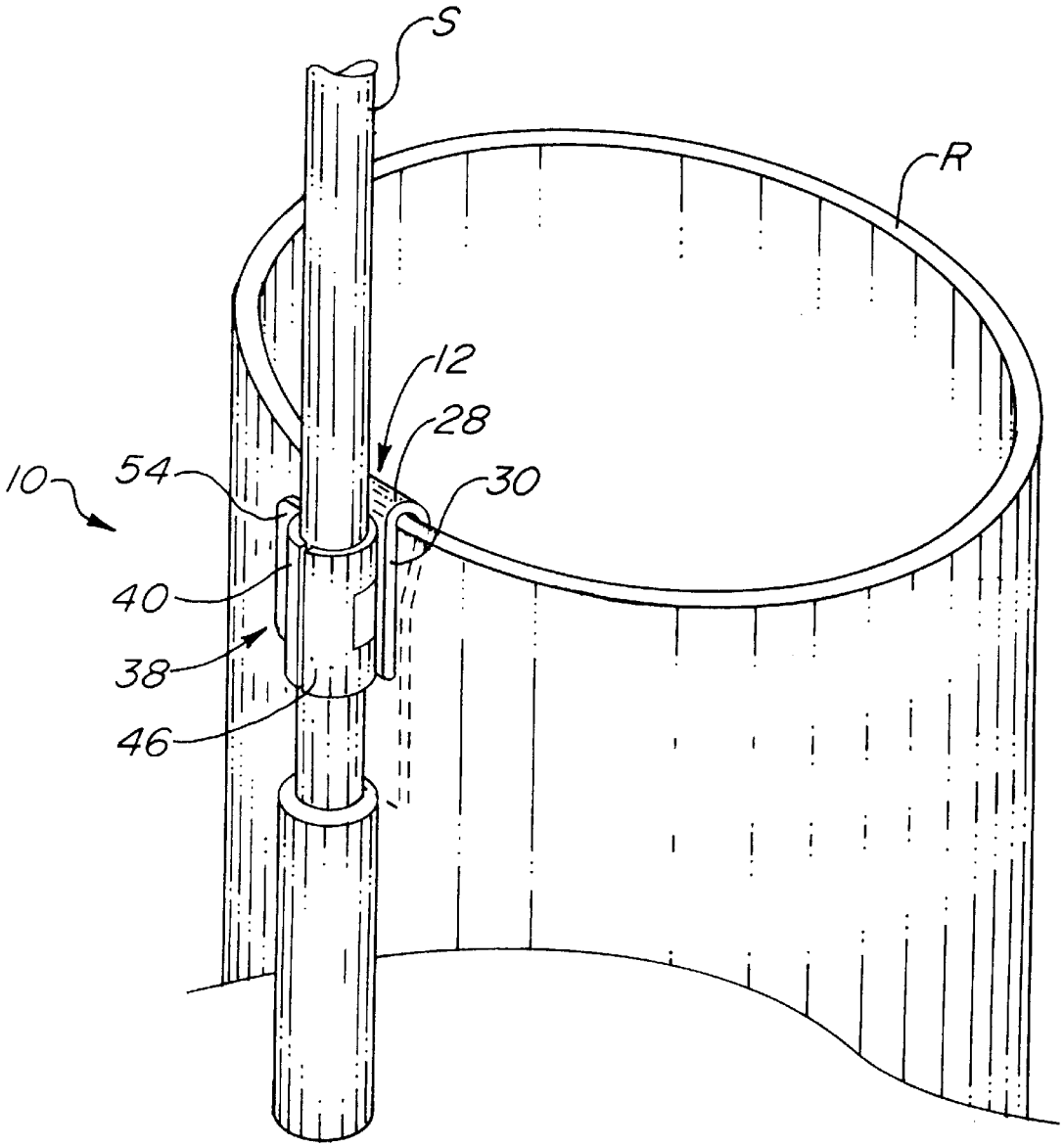
FIG. 8 is a close-up perspective view of the umbrella holder secured to a golf bag.

Referring now to the drawings, it is seen that the umbrella holder of the present invention, generally denoted by reference numeral 10, is comprised of a first clamp 12 having a first surface 14 and a second surface 16. As seen, the first clamp 12 is a clip member made from a resilient material such as spring metal, plastic, an appropriate resin and the like and has a first leg 18 with a first end 20, a medial portion 22, and a second end 24. A second leg 26 extends diagonally from the second end 24 of the first leg 18. A curved portion 28 extends from the end of the second leg 26, while a third leg 30 having a third end 32 and a fourth end 34 extends from the curved portion 28. As seen, the third leg 30 is generally parallel to the first leg 18 with the fourth end 34 of the third leg 30 terminating proximate the medial portion 22 of the first leg 18. A non-scuff material 36, such as rubber, neoprene, and the like, is secured to the second surface 16 as well as to the first end 20 of the first leg 18 and the fourth end 34 of the third leg 30.

A second clamp 38 is secured to the first surface 14 of the first clamp 12. As seen, the second clamp 38 is comprised of a first jaw 40, having a third surface 42 and a fourth surface 44, and a second jaw 46, having a fifth surface 48 and a sixth surface 50, joined by a spring-loaded hinge 52. A flange 54 extends outwardly from the third surface 42 of the first jaw 40. A non-scuff material 56, such as rubber, neoprene, and the like, is secured to the fourth surface 44 of the first jaw 40 and the sixth surface 50 of the second jaw 46.

In order to use the umbrella holder 10 of the present invention, the first clamp 12 is secured to a golf bag B such that the first leg 18 and second leg 26 are inserted into golf bag B with the third leg 30 remaining external of the golf bag B. The first clamp 12 is pushed downwardly until the curved portion 28 rests on top of the rim R of the golf bag B. The resilient nature of the first clamp 12 allows securement of the first clamp 12 in this manner and also springedly and securely holds the first clamp 12 to the golf bag B once the first clamp 12 is properly positioned. The diagonally disposed second leg 26 assures that there is an adequate separation of the first clamp 12 proximate the curved portion 28 to compensate for any additional thickness of the golf bag B due to the rim R. Lacking such additional separation, the first clamp 12 may remain open that is that but for the resilient nature of the first clamp 12, the first leg 18 would be separated such a distance from the third leg 30 that the separation overcomes the resilient tendency of the first clamp 12 resulting in the first clamp 12 not being properly secured to the golf bag B—even if the rim R adds no additional thickness to the golf bag B. The non-scuff material 36 on the first clamp 12 assures that the first clamp 12 does not damage the golf bag B or its contents during insertion thereinto or extraction therefrom.

The second clamp 38 is opened by forcing the flange 54 backwardly toward the first clamp 12 thereby squeezing open the second clamp 38. An umbrella U is positioned such that its shaft S is received between the separated first jaw 40 and second jaw 46 of the second clamp 38. The second clamp 38 is thereafter allowed to close by releasing the pressure on the flange 54. The spring-loaded hinge 52 will return the second clamp 38 to its normally closed position. The spring-loaded nature of the hinge 52 will hold the second clamp 38 in the closed position thereby maintaining the umbrella U in proper position.

While the invention has been particularly shown and described with reference to an embodiment thereof, it will be appreciated by those skilled in the art that various changes in form and detail may be made without departing from the spirit and scope of the invention.

What is claimed is:

1. An umbrella holder comprising:

a first clamp, being made from a resilient material and having a first surface and a second surface, a first leg having a first end, a medial portion, and a second end, a second leg extending diagonally from the first leg, a curved portion attached to the second leg, and a third leg having a third end attached to the curved portion and a fourth end, the third leg being generally parallel to the first leg and terminating proximate the medial portion of the first leg;

a second clamp the second clamp having a first jaw having a third surface and a fourth surface, a second jaw having a fifth surface and sixth surface, and a spring-loaded hinge connecting the first jaw with the second jaw, the hinge attached to the first surface; and a flange attached to the third surface.

2. The umbrella holder as in claim 1 wherein the resilient material is chosen from the group consisting of spring metal, plastic, and resin.

3. The umbrella holder as in claim 1 further comprising a non-scuff material secured to the second surface.

4. The umbrella holder as in claim 3 wherein the non-scuff material is chosen from the group consisting of rubber and neoprene.

5. The umbrella holder as in claim 1 further comprising a non-scuff material secured to the fourth surface and to the sixth surface.

6. The umbrella holder as in claim 5 wherein the non-scuff material is chosen from the group consisting of rubber and neoprene.

7. A holder in combination with an umbrella having a shaft, the holder comprising:

a first clamp, being made from a resilient material and having a first surface and a second surface, a first leg having a first end, a medial portion, and a second end, a second leg extending diagonally from the first leg, a curved portion attached to the second leg, and a third leg having a third end attached to the curved portion and a fourth end, the third leg being generally parallel to the first leg and terminating proximate the medial portion of the first leg;

a second clamp, adapted to hold the shaft therebetween, the second clamp having a first jaw having a third surface and a fourth surface, a second jaw having a fifth surface and sixth surface, and a spring-loaded hinge connecting the first jaw with the second jaw, the hinge attached to the first surface; and a flange attached to the third surface.

8. The holder as in claim 7 wherein the resilient material is chosen from the group consisting of spring metal, plastic, and resin.

9. The holder as in claim 7 further comprising a non-scuff material secured to the second surface.

10. The holder as in claim 9 wherein the non-scuff material is chosen from the group consisting of rubber and neoprene.

11. The holder as in claim 7 further comprising a non-scuff material secured to the fourth surface and to the sixth surface.

12. The holder as in claim 11 wherein the non-scuff material is chosen from the group consisting of rubber and neoprene.

* * * * *